US005431350A

United States Patent [19]

Purser

[11] Patent Number: 5,431,350

[45] Date of Patent: Jul. 11, 1995

[54] SCRAP FRAGMENTIZER

[76] Inventor: Brian Purser, Caverswall Common, Stoke-on-Trent ST11 9EX, England

[21] Appl. No.: 189,281

[22] Filed: Feb. 1, 1994

Related U.S. Application Data

[63] Continuation-in-part of Ser. No. 62,900, May 18, 1993.

[51] Int. Cl.[6] ..... B02C 18/18; B02C 18/22; B02C 21/02

[52] U.S. Cl. ..... 241/101.72; 241/222; 241/243; 241/273.3

[58] Field of Search ..... 241/101.7, 222, 242, 241/260.1, 273.3, 243

[56] References Cited

U.S. PATENT DOCUMENTS

| | | | |
|---|---|---|---|
| 3,335,967 | 8/1967 | Williams | 241/35 |
| 3,608,837 | 9/1971 | Panning et al. | 241/36 |
| 3,859,910 | 1/1975 | Swanson, Jr. | 100/100 |
| 3,931,841 | 1/1976 | Blum | 144/309 R |
| 4,099,678 | 7/1978 | Brewer | 241/243 |
| 4,236,554 | 12/1980 | Nicholson | 144/34 R |
| 4,884,757 | 12/1989 | Streicher | 241/222 |
| 5,158,126 | 10/1992 | Lang | 144/375 |

*Primary Examiner*—John Husar
*Attorney, Agent, or Firm*—W. Thad Adams, III

[57] ABSTRACT

A scrap fragmentizer for reducing light scrap metal structures into small pieces of scrap metal. The apparatus includes an apparatus housing having a scrap-receiving opening for receiving the metal structures to be fragmentized, and a discharge opening for discharging fragmentized pieces of scrap metal. The apparatus is attached to a vehicle having a source of hydraulic power. A feed roller and fragmentizing rotor are powered by the source of hydraulic power for feeding metal structures in the scrap-receiving opening into the apparatus housing and for fragmentizing the metal structures into small pieces of scrap metal. The fragmentized metal structures are discharged through a discharge opening in small pieces ready for further processing.

12 Claims, 8 Drawing Sheets

SCRAP FRAGMENTIZER

TECHNICAL FIELD AND BACKGROUND OF THE INVENTION

This application is a continuation-in-part of Applicant's application Ser. No. 062,900, filed May 18, 1993 now pending.

This invention relates to a scrap fragmentizer. In the embodiments disclosed in this application, the fragmentizer is intended to be constructed either as an attachment to a hydraulic-powered vehicle such a backhoe, as a freestanding unit at a fixed site, or moveable from site to site by means other than by attachment to a backhoe or similar vehicle. The hydraulic power supply of the backhoe or a separate hydraulic power system is used to power the scrap fragmentizer.

The purpose of the apparatus is to reduce large volume light steel and other metal structures into small, chopped-up pieces of scrap metal which are therefore very dense, compact and easy to transport. Scrap iron and steel is sold by the ton. The more scrap per unit of volume, the easier and less expensive per ton to transport. This fact provides a substantial incentive for scrap to be reduced to a dense form before resale and recycling.

Light steel (sheet steel) is used for structures which enclose large volumes of empty space, for example, oil drums. The value of oil drums as scrap is very low because of the relatively low weight which can be transported in a single load, on, for example, a truck or rail car. In other words, when transporting, for example, empty oil drums, it is mostly air which is being transported. However, when chopped or fragmentized into small pieces, a very substantial quantity of light steel can be transported in a single load. Its value as scrap is therefore greatly increased.

The present invention is intended to fragmentize into suitable small pieces of scrap such things as oil drums, discarded washing machines, stoves, dishwashers, water heaters, refrigerators, file cabinets, car and truck bodies and many other sheet steel products.

Presently, such products are reduced to scrap by a "fragmentizer"—a stationary machine which can occupy up to one-half acre and cost between four and seven million dollars. Such prior art fragmentizers are powered by a 1000 to 3000 horsepower electric or diesel electric motor, and therefore use large quantities of electric power or diesel fuel.

Prior art fragmentizers also create large amounts of dust and noise and present a high visual profile. The machines operate at very high speeds of up to 900 rpm of the main rotor, and therefore require considerable maintenance. The main rotor has a number of swinging hammers which flail at the steel structure and pound it into fragments by knocking lumps of metal off of the scrap. This causes extensive wear on the fragmentizer. Such fragmentizers can produce between 500 and 1200 tons of scrap per 40 hour week. The scrap must be transported to the fragmentizer since the fragmentizer is so large it is by necessity stationary.

In contrast, the fragmentizer invention according to this application can use energy already available from the hydraulic system of a vehicle such as a backhoe or similar type of construction equipment, or from a relatively compact hydraulic motor. The main rotor runs at a much slower speed, and cuts the steel rather than pounding it to bits. This creates much less noise and wear. The compact size of the apparatus permits it to be moved to locations where the scrap is located. An apparatus according to the present invention can very inexpensively produce about 200 tons of scrap per 40 hour week.

SUMMARY OF THE INVENTION

Therefore, it is an object of the invention to provide a scrap fragmentizer.

It is another object of the invention to provide a scrap fragmentizer which can be attached to the boom of a vehicle such as a backhoe excavator.

It is another object of the invention to provide a scrap fragmentizer which uses the hydraulic power source of a vehicle to which it is attached.

It is another object of the invention to provide a scrap fragmentizer which cuts light steel into small pieces.

It is another object of the invention to provide a scrap fragmentizer which operates with relatively little noise and which uses energy efficiently.

It is another object of the invention to provide a scrap fragmentizer which has a rotor which operates at relatively slow speed and thus requires relatively little maintenance.

It is another object of the invention to provide a scrap fragmentizer which is relatively inexpensive.

These and other objects of the present invention are achieved in the preferred embodiments disclosed below by providing a scrap fragmentizer for reducing light scrap metal structures into small pieces of scrap metal. The scrap fragmentizer has an apparatus housing with a scrap-receiving opening for receiving the metal structures to be fragmentized, and a discharge opening for discharging fragmentized pieces of scrap metal. A source of hydraulic power is provided for supplying hydraulic power to the fragmentizer. Scrap feeding means are provided for feeding metal structures in the scrap-receiving opening into the apparatus housing. Scrap fragmentizing means is provided, and is powered by the source of hydraulic power. The scrap fragmentizing means is positioned in the apparatus housing between the scrap feeding means and the discharge opening for fragmentizing the metal structures into small pieces of scrap metal as they are fed to the scrap fragmentizing means from the scrap feeding means, and discharging the fragmentized metal structures through the discharge opening.

According to one preferred embodiment of the invention, the scrap feeding means comprises a feed roller positioned in the scrap-receiving opening and rotating in a direction to push the scrap metal structures under the feed roller and into the apparatus housing.

According to another preferred embodiment of the invention, the feed roller includes a plurality of metal creasing and cutting members positioned on a peripheral surface of the feed roller.

According to yet another preferred embodiment of the invention, each of the metal creasing and cutting members comprises a blade positioned on the peripheral surface of the feed roller in spaced-apart relation to each other.

According to yet another preferred embodiment of the invention, the scrap fragmentizing means comprises a fragmentizing roller having fragmentizing teeth positioned on a peripheral surface thereof.

According to yet another preferred embodiment of the invention, the fragmentizing teeth comprise hardened steel and are positioned in spaced-apart staggered relation on the peripheral surface of the fragmentizing roller along the axial length thereof.

According to yet another preferred embodiment of the invention,the teeth have a relatively large base proximal to the fragmentizing roller by which the teeth of attached to the peripheral surface of the fragmentizing roller and a distal cutting blade, the longitudinal axis of the blade extending in the direction of the axis of rotation of the fragmentizing roller.

According to yet another preferred embodiment of the invention, the scrap fragmentizer includes at least one hydraulic motor hydraulically connected to the source of hydraulic power.

According to yet another preferred embodiment of the invention, the housing includes a plurality of wear ribs in the scrap-receiving opening.

According to yet another preferred embodiment of the invention, adjustment means are provided for adjusting the size of the scrap receiving opening relative to the feed roller.

According to yet another preferred embodiment of the invention, a rotatably-mounted pinion gear is attached to the source of hydraulic power for outputting power from the source of hydraulic power, and a torque gear is mounted in gear driven relation to the pinion gear for being rotatably driven by the pinion gear. The torque gear is mounted in driving relation to the fragmentizing roller for rotating the fragmentizing roller.

Preferably, the diameter of the torque gear to the diameter of the pinion gear is 3 to 1, thereby resulting in a reduced torque gear rpm and increased torque relative to the pinion gear. In a preferred embodiment, the pinion gear has a diameter of 43 centimeters with 33 gear teeth, and the torque gear has a diameter of 132 centimeters with 101 teeth.

According to yet another preferred embodiment of the invention, an anvil is provided for supporting the scrap metal as it is engaged by the fragmentizing roller and the fragmentizing teeth thereon.

According to yet another preferred embodiment of the invention, a scrap fragmentizer is provided for reducing light scrap metal structures into small pieces of scrap metal. The apparatus includes an apparatus housing having a top wall, first and second opposing and spaced-apart sidewalls, and a bottom wall opposing and spaced-apart from the top wall, the top wall, the bottom wall and the sidewalls defining a scrap-receiving opening for receiving the metal structures to be fragmentized and also defining a discharge opening through which fragmentized pieces of scrap metal are discharged. A source of hydraulic power is provided for supplying hydraulic power to the apparatus housing.

A feed roller is powered by the Source of hydraulic power for feeding metal structures in the scrap-receiving opening into the apparatus housing, and a scrap fragmentizing roller is powered by the source of hydraulic power and positioned in the apparatus housing between the scrap feeding roller and the discharge opening for fragmentizing the metal structures into small pieces of scrap metal as they are fed to the scrap fragmentizing roller from the scrap feeding roller, and discharging the fragmentized metal structures through the discharge opening.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
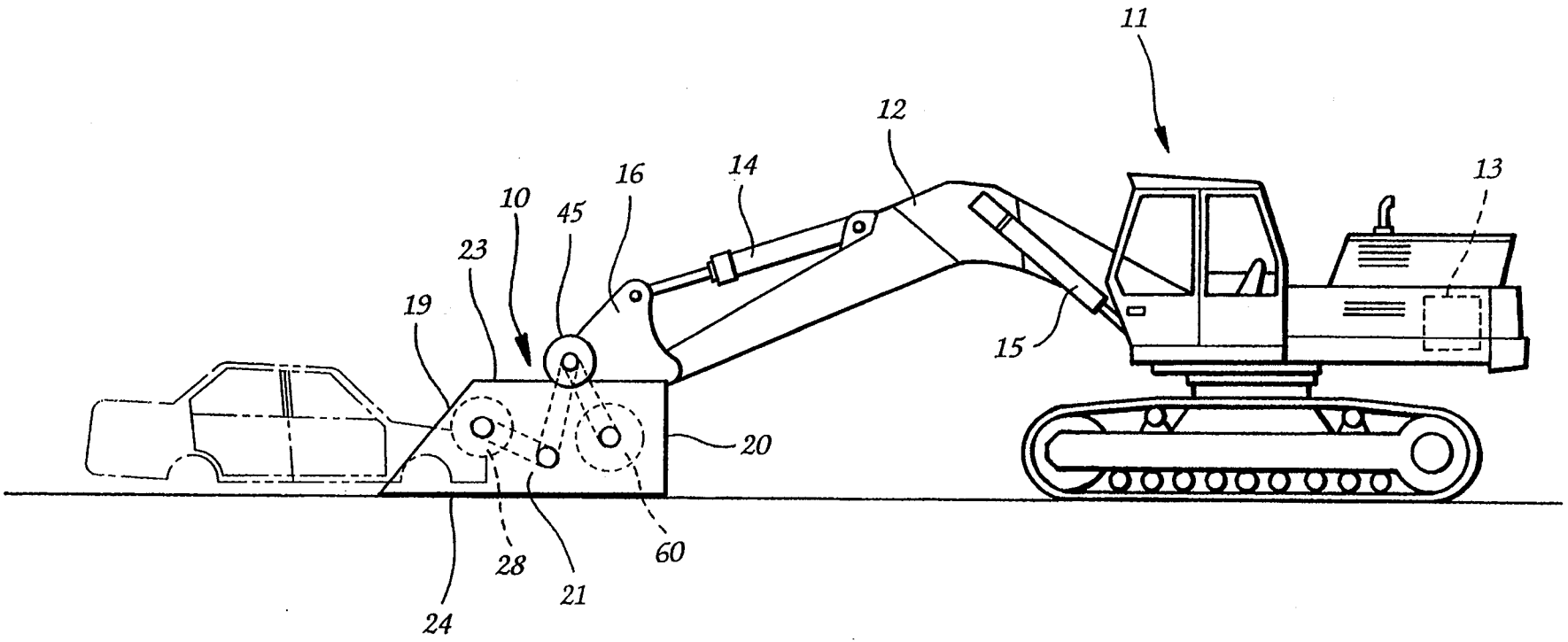
FIG. 1 is a side elevation of the mobile scrap fragmentizer according to an embodiment of the invention, connected to a backhoe.

Referring now specifically to the drawings, a mobile scrap fragmentizer according to the present invention is illustrated in FIG. 1 and shown generally at reference numeral 10. The mobile scrap fragmentizer 10 is attached to a backhoe vehicle 11 having a boom 12 which normally carries a backhoe or other excavating implement. Backhoe vehicle 11 includes a hydraulic system 13 which supplies hydraulic power to the boom 12 and to the excavating or other implement. Boom 12 includes hydraulic cylinder assemblies 14 and 15 which permit the boom 12 to be manipulated.

Boom 12 has a mounting bracket 16 mounted on the end, and onto which is mounted the backhoe in its conventional usage, and when used as illustrated in FIG. 1, the scrap fragmentizer 10. As is shown in FIG. 1, the scrap fragmentizer 10 can be positioned wherever desired and used to process light scrap metal, such as the car body shown. In such instances, the engine block, transmission housings, axles and other heavy steel members are first removed from the car body before processing begins.

The scrap fragmentizer 10 may be placed at ground level, or may be positioned substantially above ground level if desired, and positioned over a dump truck or rail car, so that processed scrap from the scrap fragmentizer 10 is discharged directly into a transport vehicle which can be moved away when full. Conversely, the scrap fragmentizer 10 can easily be moved from place to place as scrap processing takes place.

Figure 2:
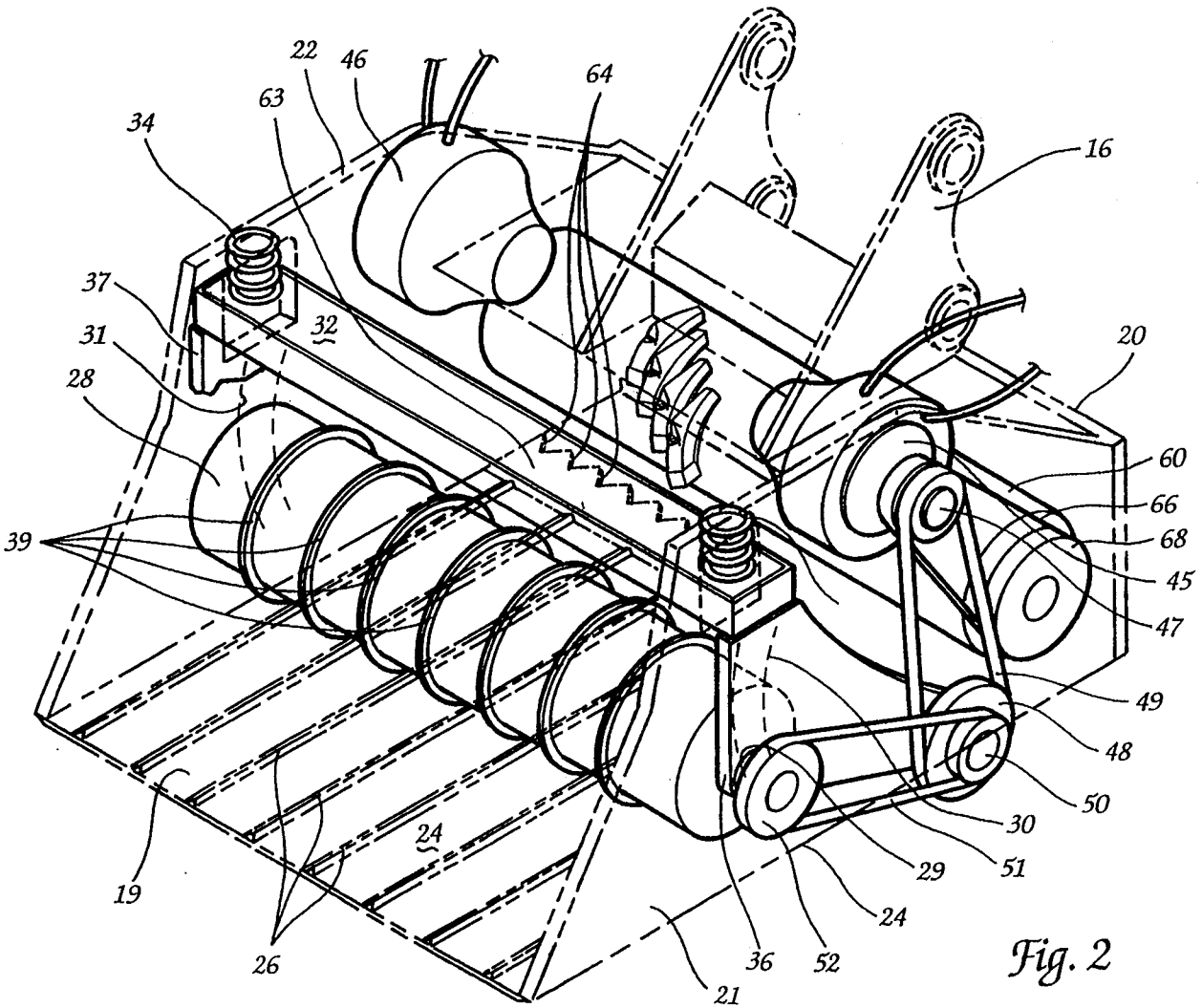
FIG. 2 is an enlarged perspective view of the mobile scrap fragmentizer shown in FIG. 1, with parts broken away for clarity.

Referring now to FIG. 2, scrap fragmentizer 10 has a housing which includes a scrap-receiving opening 19 on the front end, a discharge opening 20 on the rear end, opposed sidewalls 21 and 22 and opposed top and bottom walls 23 and 24. The bottom wall 24 extends forward to form a "scoop" which will support metal structures as they are being fed into the opening 19. Wear ribs 26 reduce wear on the bottom wall 24 and also reduce friction between the bottom wall 24 and the scrap as it is fed into the opening 19. Scrap is pulled into the scrap fragmentizer 10 by a feed roller 28. Feed roller 28 is mounted for rotation on an axle 29 which rides in curved adjustment slots 30 and 31 in side walls 21 and 22, respectively. In the embodiment shown in the drawings, feed roller 28 has a diameter of 18 inches (46 cm). A torque beam 32 carries a pair of high resistance load springs 33 and 34 which spring load feed roller 28. Feed roller 28 cooperates with the load springs through a pair of mounting brackets 36 and 37.

Feed roller 28 includes several raised ribs 39 which extend around the periphery of the feed roller 28 and which crease the metal as it feeds into the scrap fragmentizer 10. The ribs 39 also do some cutting, weakening and bending of the metal and generally provide a preliminary processing step to the major cutting which will subsequently take place. The ribs also provide enhanced gripping of the metal as it is pulled into the scrap fragmentizer 10, and cooperate with the wear ribs 26 on the bottom wall 24 to provide positive engagement against the metal as its reduction to scrap begins. Thus, the ribs 26 and 39 cooperate to begin the scrap-generating process and provide positive gripping to insure that the metal is fed properly into the scrap fragmentizer 10.

Feed roller 28 is driven by a pair of hydraulic motors 45 and 46 which are powered by hydraulic fluid from the hydraulic power system 13 of the backhoe 11. A single hydraulic motor may also be used. A drive gear 47 powered by hydraulic motor 45 transmits rotary motion to a driven gear 48 through a drive chain 49. The rotational speed of the hydraulic motor 45 is stepped down by a concentric driven gear 50 of reduced diameter, which in turn transmits rotary motion through a drive chain 51 to a gear 52 mounted on the end of axle 29. Hydraulic motor 46 functions in exactly the same way as described above and therefore will not be separately described.

Figure 3:
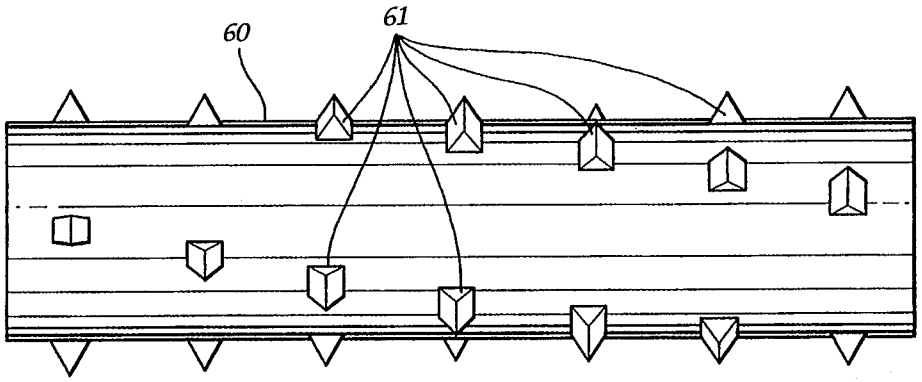
FIG. 3 is a side elevation of the fragmentizer roller.
Figure 4:
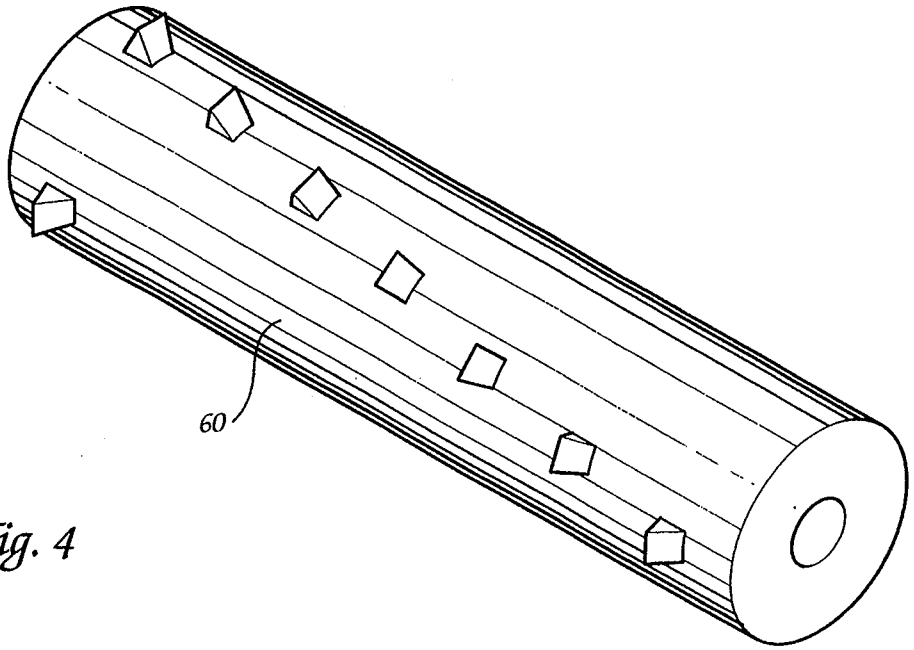
FIG. 4 is a simplified perspective view of the fragmentizer roller shown in FIG. 3.

The primary fragmentizing function of the scrap fragmentizer 10 is carried out by a fragmentizing rotor 60. In the embodiment disclosed in this application, the fragmentizing rotor 60 has a diameter of 21 inches (53 cm). The fragmentizing rotor 60 is mounted for rotation in the downstream end of the scrap fragmentizer 10 adjacent the discharge opening 20. Referring now to FIGS. 3 and 4, the fragmentizing rotor 60 is provided with four axially-extending rows of fragmentizing teeth 61. Each of the fragmentizing teeth 61 is relatively wide at its base. The sides of each of the teeth 61 converge to form a distal blade aligned with the direction of rotation of the fragmentizing rotor 60, and which slice into the metal as the fragmentizing rotor 60 rotates. The teeth 61 may be welded or bolted onto the peripheral surface of the fragmentizing rotor 60. The teeth are formed of hardened steel. Note that the rows of teeth 61 are staggered row by row, so that a single row of teeth progressively extends tooth-by-tooth approximately 85 degrees around the circumference of the fragmentizing rotor 60. This arrangement provides a much smoother and more efficient fragmentizing action, since a piece of metal is being progressively impacted and fragmentized along the length of the fragmentizing rotor 60, instead of being impacted all at once along its entire width.

Fragmentizing teeth 61 cooperate with an anvil 63 which is formed on the back edge of the bottom wall 24 below the fragmentizing rotor 60. Anvil 63 includes a series of serrations 64 which align with the teeth 61 on fragmentizing rotor 60. The spacing between the serrations 64 and adjacent teeth 61 is quite close—on the order of 0.01 inches (0.0254 cm). Ideally, only one tooth 61 is cutting at any given instant, thereby maximizing the force that tooth 61 can apply to the metal. Of course, two or more teeth 61 can be made to cut at a single instant, particularly if the material is relatively thin or soft.

The impact of the teeth 61 and the fragmentizing rotor 61 drives the metal being fragmentized against the anvil 63, and the rotation of the shedding rotor 60 causes the metal to be driven into and past the serrations 64, causing further fragmentizing of the metal, and completing the fragmentizing operation. During cutting, the teeth 61 are moving in the same direction as the metal being fragmentized, thereby preventing the metal from being bunched or merely crimped instead of being cleanly cut. Fragmentized metal is discharged through the discharge opening 20 and onto the ground or into whatever container is placed under and behind the discharge opening 20 to receive the fragmentized metal.

Referring again to FIG. 2, fragmentizing rotor 60 is driven by the hydraulic motors 45 and 46. As with the feed roller 28, a single hydraulic motor may be used. Fragmentizing rotor 60 is driven through drive gear 47 and a drive chain 66 which provides rotational motion to a driven gear 68 mounted on one end of fragmentizing rotor 60. Hydraulic motor 46 functions in exactly the same way as described above and therefore is not separately described. Fragmentizing rotor 60 rotates faster than the feed roller 28—on the order of 5% faster. This has the effect of pulling the scrap metal between the feed roll 28 and the fragmentizing rotor 60 into the fragmentizing rotor 60 and anvil 63, and further discharging the fragmentized metal from the fragmentizing rotor 60 and anvil 63 into the discharge opening 20. The tears and cuts made by the teeth 61 and the serrations 64 are thus widened, and incomplete tears and cuts are completed. The scrap metal discharged from the scrap fragmentizer 10 is therefore in small, separate pieces with do not require further fragmentizing before being sent to a steel mill for remelting. The small, separate pieces are easily separated at subsequent steps where steel is segregated from aluminum, plastic and other components of the scrap contents.

It should be emphasized that the scrap metal in the above-described process is being cut into pieces, not hammered into pieces. The simultaneous operation of the feed roller 28, the fragmentizing rotor 60 and the anvil 63 create maximum cutting force with relatively little noise in comparison with known fragmentizers which rely on hammers to knock chunks of metal off of larger pieces.

The scrap fragmentizer 10 illustrated in this application is of a size and power to receive and process a typical car body. Thus, the opening 19 is approximately five and one-half feet (1.5 meters) wide and approximately five feet (1.5 meters) high. The number and spacing of the teeth 61, the speed of rotation of the feed roller 28 and the fragmentizing rotor 60 are, of course, a matter of choice which the responsible engineer will select to fit particular circumstances. Of course, smaller scrap metal objects can easily be processed in a scrap fragmentizer large enough to process much larger metal objects. If desired, fragmentizing rotors with different sized, spaced and shaped teeth can be provided, and installed on a single scrap fragmentizer as desired to optimize processing of particular types of scrap on a given scrap fragmentizer.

A much smaller and lower-powered scrap fragmentizer 10 can be engineered especially to process, for example, discarded appliances or oil drums. Much larger and higher-powered units can also be engineered to process truck bodies and large storage tanks. In each case, the size and power needed is determined from the scrap metal to be processed and the vehicle providing the hydraulic power.

Figure 5:
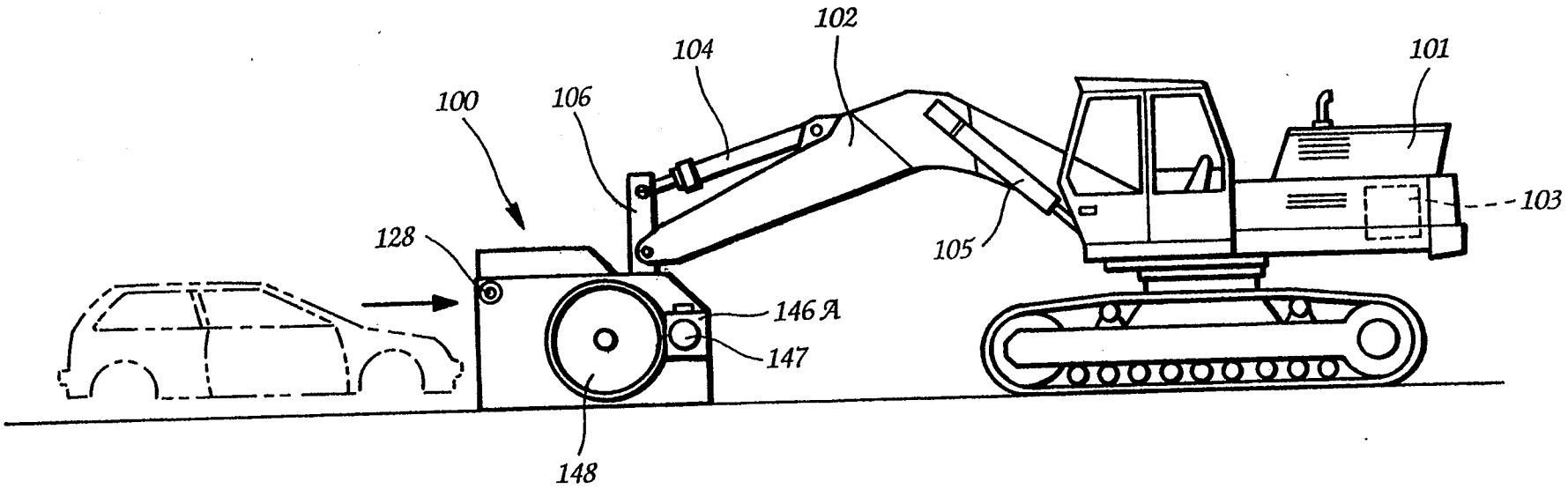
FIG. 5 is a side elevation of the mobile scrap fragmentizer according to another embodiment of the invention, connected to a backhoe.

Referring now to FIG. 5, a scrap fragmentizer according to another embodiment of the present invention is illustrated in FIG. 5 and shown generally at reference numeral 100. The scrap fragmentizer 100 is attached to a backhoe vehicle 101 having a boom 102 which normally carries a backhoe or other excavating implement. Backhoe vehicle 101 includes a hydraulic system 103 which supplies hydraulic power to the boom 102 and to the excavating or other implement. Boom 102 includes hydraulic cylinder assemblies 104 and 105 which permit the boom 102 to be manipulated.

Boom 102 has a mounting bracket 106 mounted on the end, and onto which is mounted the backhoe 101 in its conventional usage, and when used as illustrated in FIG. 5, the scrap fragmentizer 100. As is shown in FIG. 5, the scrap fragmentizer 100 can be positioned wherever desired and used to process light scrap metal, such as the car body shown. In such instances, the engine block, transmission housings, axles and other heavy steel members are removed from the car body before processing begins.

Figure 9:
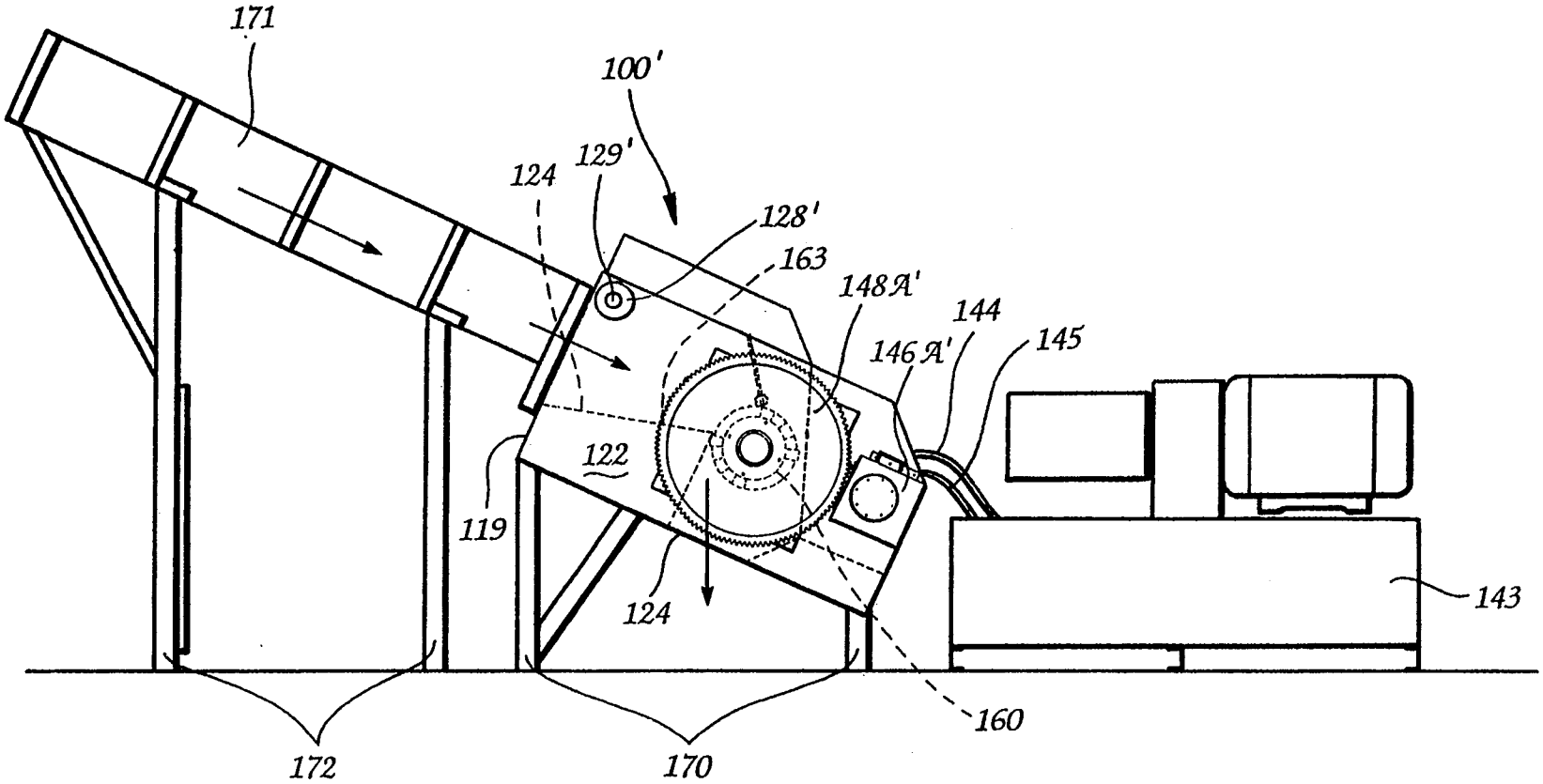
FIG. 9 is a side elevation of a scrap fragmentizer permanently located at a particular use site, and powered by a hydraulic power pack.
Figure 10:
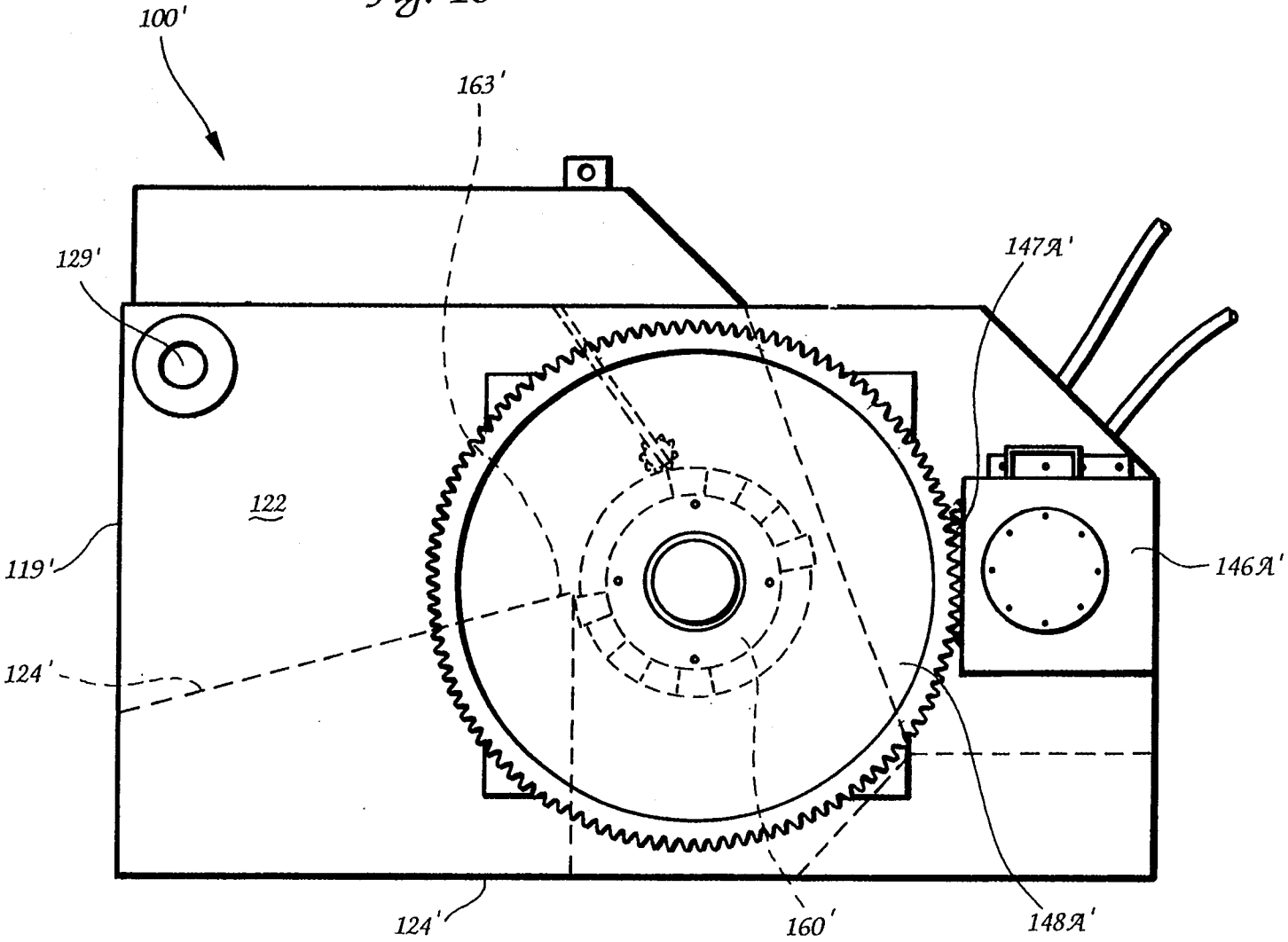
FIG. 10 is an enlarged side elevation of the fragmentizer shown in FIG. 9.

The scrap fragmentizer 100 may be placed at ground level, or may be positioned substantially above ground level if desired, and positioned over a dump truck or rail car, so that processed scrap from the scrap fragmentizer 100 is discharged directly into a transport vehicle which can be moved away when full. Thus, the scrap fragmentizer 100 can easily be moved from place to place as scrap processing takes place. Alternatively, the fragmentizer 100 may be positioned on a stationary pad or foundation for use at a fixed location, as is shown in FIG. 9. Thus, the fragmentizer may be considered "fixed" to the extent that it is located at a fixed location, but yet still be "mobile", since it is small enough to move to a new site whenever desired, by, for example, reattaching it to the end of the boom 102 of the backhoe 101 for transport, by lifting it with a crane onto a flatbed truck, or by other conventional transport means.

Figure 6:
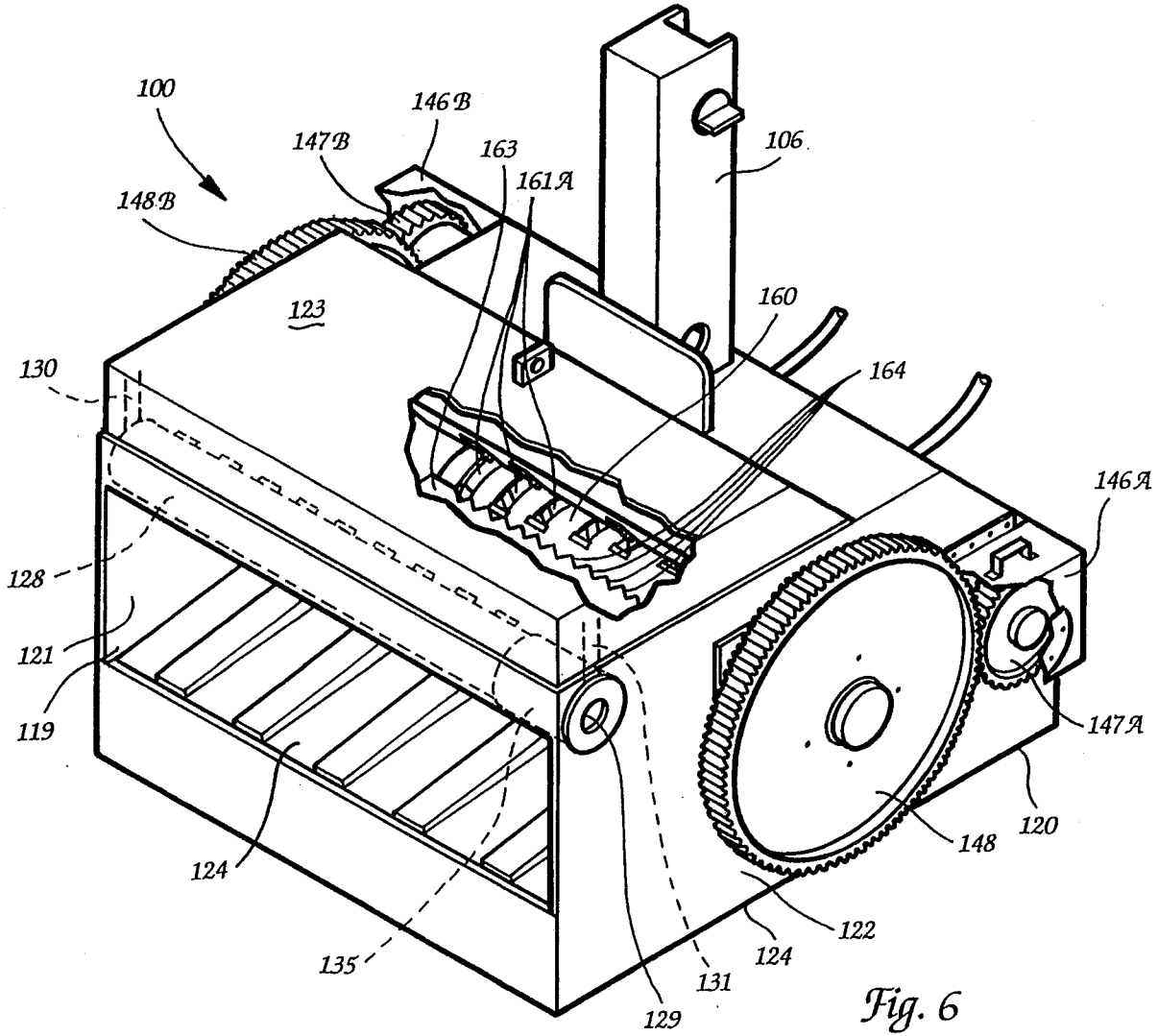
FIG. 6 is an enlarged perspective view of the mobile scrap fragmentizer shown in FIG. 6, with parts broken away for clarity.

Referring now to FIG. 6, scrap fragmentizer 100 has a housing which includes a scrap-receiving opening 119 on the front end, a discharge opening 120 on the bottom, opposed sidewalls 121 and 122 and opposed top and bottom walls 123 and 124. The bottom wall 124 extends forward to form a "scoop" which will support metal structures as they are being fed into the opening 119. Scrap is pulled into the scrap fragmentizer 100 by a feed roller 128. Feed roller 128 is mounted for rotation on an axle 129 which rides in adjustment slots 130 and 131 in side walls 121 and 122, respectively. In the embodiment shown in the drawings, feed roller 128 has a diameter of 46 centimeters.

Feed roller 128 includes teeth 139 which extend around the periphery of the feed roller 128 and which pull the metal into the fragmentizer 100. The feed roller 128 is driven by a single hydraulic motor mounted on one end of the feed roller 128 and driven by power from the hydraulic motor power system 103 of the backhoe 101.

Two pinion gears 147A and 147B are powered by hydraulic system 103 through hydraulic motors 146A and 146B. Pinion gears 147A and 147B transmit rotary motion to a pair of torque gears 148A and 148B by direct gear drive from the pinion gears 147A and 147B, respectively. In actual use, the torque gears 148A and 148B would be enclosed by protective covers.

Figure 7:
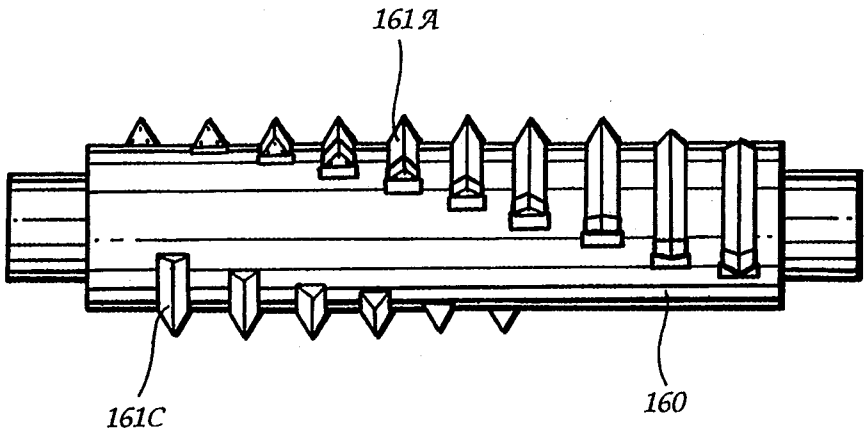
FIG. 7 is a side elevation of the fragmentizer roller.
Figure 8:
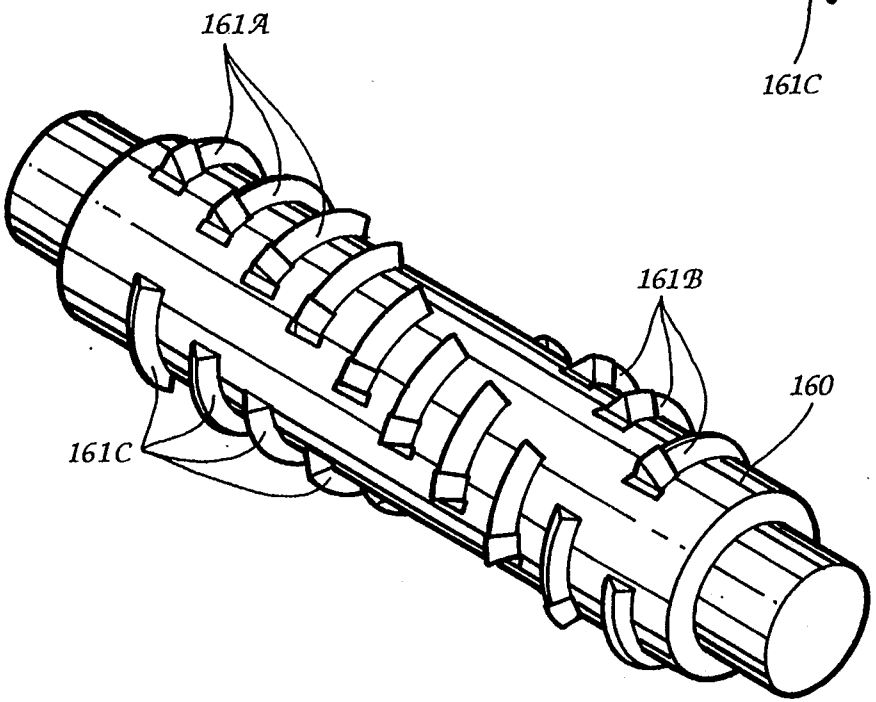
FIG. 8 is a simplified perspective view of the fragmentizer roller shown in FIG. 7.

The primary fragmentizing function of the scrap fragmentizer 100 is carried out by a fragmentizing rotor 160, as is best illustrated in FIGS. 6, 7 and 8. In the embodiment disclosed in this application, the fragmentizing rotor 160 has a diameter of 21 inches (53 cm). The fragmentizing rotor 160 is mounted for rotation intermediate the side walls 121, 122 and is positioned over the discharge opening 120. The rotor 160 is mounted concentrically with the torque gears 148A and 148B and is driven by the rotation of the torque gears 148A, 148B. Therefore, the rotor 160 is simultaneously driven from opposite ends by separate hydraulic motors, thereby creating the tremendous torque needed to fragmentize the metal and relatively low rpm of the rotor 160.

Referring now to FIGS. 7 and 8, the fragmentizing rotor 160 is provided with three rows of elongate fragmentizing teeth 161A, 161B and 161C. The fragmentizing teeth 161A, 161B, 161C are offset relative to the other teeth in the same row, so that each row 161A, 161B, 161C forms a helical pattern. In other words, the three rows of teeth 161A, 161B, 161C are progressively offset both axially and radially along the length of the rotor 160. In addition, as is best shown in FIG. 7, each row 161A, 161B, 161C is axially offset relative to its adjacent row, so that the metal being fragmentized is impacted sequentially by teeth out of axial alignment with each other. This arrangement provides a much smoother and more efficient fragmentizing action, since a piece of metal is being progressively impacted and fragmentized along the length of the fragmentizing rotor 60, instead of being impacted all at once along its entire width.

Each tooth extends radially around the circumference of the rotor 160 for approximately 80 degrees of arc, with spacing of about 40 degrees of arc between nearest teeth in adjacent rows 161A, 161B, 161C. The sides of each of the teeth 161A, 161B, 161C converge to form a distal blade aligned with the direction of rotation of the fragmentizing rotor 160, and which slice into the metal as the fragmentizing rotor 160 rotates. The teeth 161A, 161B, 161C may be welded or bolted onto the peripheral surface of the fragmentizing rotor 160. The teeth are formed of hardened steel. Fragmentizing teeth 161A, 161B, 161C cooperate with an anvil 163 which is formed on the back edge of the bottom wall 124 below the fragmentizing rotor 160. Anvil 163 includes a series of serrations 164 which align with the teeth 161A, 161B, 161C on fragmentizing rotor 160. The spacing between the serrations 164 and teeth 161A, 161B, 161C is quite close—on the order of 0.01 inches (0.0254 cm). Ideally, only one tooth 161A, 161B, or 161C is cutting at any given instant, thereby maximizing the force that any single tooth 161 can apply to the metal at any moment in time.

The impact of the teeth 161A, 161B, 161C of the fragmentizing rotor 160 drives the metal being fragmentized against the anvil 163, and the rotation of the rotor 160 causes the metal to be driven into and past the serrations 164, causing further fragmentizing of the metal, and completing the fragmentizing operation. During cutting, the teeth 161A, 161B, 161C are moving in the same direction as the metal being fragmentized, thereby preventing the metal from being bunched or merely crimped instead of being cleanly cut. Fragmentized metal is discharged through the discharge opening 120 and onto the ground or into whatever container is placed under and behind the discharge opening 120 to receive the fragmentized metal.

Referring again to FIG. 6, fragmentizing rotor 160 is driven by the torque gears 148A and 148B. Fragmentizing rotor 160 rotates faster than the feed roller 128—on the order of 5% faster. This has the effect of pulling the scrap metal between the feed roll 128 and the fragmentizing rotor 160 into the fragmentizing rotor 160 and anvil 163, and further discharging the fragmentized metal from the fragmentizing rotor 160 and anvil 163 into the discharge opening 120. The tears and cuts made by the teeth 161A, 161B, 161C and the serrations 164 in the anvil 163 are thus widened, and incomplete tears and cuts are completed.

The scrap fragmentizer 100 illustrated in this application is of a size and power to receive and process a typical car body. Thus, the opening 19 is approximately five and one-half feet (1.5 meters) wide and approximately five feet (1.5 meters) high. The number and spacing of the teeth 161A, 161B and 161C, the speed of rotation of the feed roller 128 and the fragmentizing rotor 160 are, of course, a matter of choice which the engineer will select to fit particular circumstances.

Referring now to FIG. 9, another embodiment of a fragmentizer 100' according to the preferred embodiment is shown, with like elements being indicated by prime reference numerals. The fragmentizer 100' is mounted on supports 170, and is fed by an inclined feed conveyor 171 mounted on supports 172. In this fixed position, the fragmentizer 100' is powered by a hydraulic power system 143 fed to the fragmentizer 100' by hydraulic feed lines 144, 145. Hydraulic motors 146A' and 146B' connected to the pinion gears 147A' and 147B', respectively, drive the torque gears 148A' and 148B', as described above.

In the embodiments described above, the rpm of the rotor 160 will vary between 12 and 60, depending on the material being cut and the rate of feed. Torque will range between 27,000 and 87,000 joules. Metric hydraulic horsepower ranges between 165 and 625. Hydraulic oil flow ranges between 380 and 760 liters/minute, and oil pressure between 351,500 and 3,800,000 kg/sq meter. The torque gear 148 is 132 centimeters in diameter with 101 teeth, and the pinion gear is 43 centimeters in diameter with 33 teeth.

A scrap fragmentizer is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A scrap fragmentizer for reducing light scrap metal structures into small pieces of scrap metal, comprising:

(a) an apparatus housing having a scrap-receiving opening for receiving the metal structures to be fragmentized, and a discharge opening for discharging fragmentized pieces of scrap metal;

(b) a source of hydraulic power for supplying hydraulic power to said fragmentizer;

(c) scrap feeding means for feeding metal structures in the scrap-receiving opening into the apparatus housing;

(d) scrap fragmentizing means powered by said source of hydraulic power and positioned in said apparatus housing between said scrap feeding means and said discharge opening for fragmentizing the metal structures into small pieces of scrap metal as they are fed to the scrap fragmentizing means from the scrap feeding means, and discharging the fragmentized metal structures through the discharge opening, said scrap fragmentizing means comprising a rotor having a plurality of outwardly-extending triangular teeth positioned in staggered relation around the periphery of the rotor, each of said teeth being aligned with the direction of rotation of said rotor;

(e) an anvil positioned between the scrap feeding means and the rotor, said anvil having a serrated edge defined by a plurality of laterally-extending triangular-shaped serrations positioned in corresponding alignment with respective ones of said triangular teeth and having a triangular shape corresponding to the triangular shape of said teeth; the plane of said teeth and the plane of said anvil intersecting to cause passage of said teeth past respective ones of said serrations in closely spaced-apart metal fragmentizing relation to each other; and (f) wherein said teeth are spaced on said rotor so that only one tooth is in cutting engagement with said anvil at any one time.

2. A scrap fragmentizer according to claim 1, wherein said scrap feeding means comprises a feed roller positioned in the scrap-receiving opening and rotating in a direction to push the scrap metal structures under the feed roller and into the apparatus housing.

3. A scrap fragmentizer according to claim 2, wherein said feed roller includes a plurality of metal creasing and cutting members positioned on a peripheral surface of the feed roller.

4. A scrap fragmentizer according to claim 3, wherein said each of said metal creasing and cutting members comprises a blade positioned on the peripheral surface of the feed roller in spaced-apart relation to each other.

5. A scrap fragmentizer according to claim 2, wherein said apparatus housing includes a plurality of wear ribs in the scrap-receiving opening.

6. A scrap fragmentizer according to claim 2, and including adjustment means for adjusting the size of the scrap receiving opening relative to the feed roller.

7. A scrap fragmentizer according to claim 1, wherein said fragmentizing teeth comprise hardened steel.

8. A scrap fragmentizer according to claim 7, wherein said teeth have a relatively large base proximal to said fragmentizing roller by which the teeth of attached to the peripheral surface of the fragmentizing roller and a distal cutting blade, the longitudinal axis of said blade extending in the direction of the axis of rotation of the fragmentizing roller.

9. A scrap fragmentizer according to claim 1, wherein the scrap fragmentizer includes at least one hydraulic motor hydraulically connected to said source of hydraulic power.

10. A scrap fragmentizer according to claim 1, and including a rotatably-mounted pinion gear attached to said source of hydraulic power for outputting power from said source of hydraulic power, and a torque gear mounted in gear driven relation to said pinion gear for being rotatably driven by said pinion gear, said torque gear mounted in driving relation to said fragmentizing roller for rotating said fragmentizing roller.

11. A scrap fragmentizer according to claim 1, wherein the diameter of said torque gear to the diameter of the pinion gear is 3 to 1, thereby resulting in a reduced torque gear rpm and increased torque relative to said pinion gear.

12. A scrap fragmentizer for reducing light scrap metal structures into small pieces of scrap metal, comprising:

(a) an apparatus housing having a top wall, first and second opposing and spaced-apart sidewalls, and a bottom wall opposing and spaced-apart from said top wall, said top wall, said bottom wall and said sidewalls defining a scrap-receiving opening for receiving the metal structures to be fragmentized and also defining a discharge opening through which fragmentized pieces of scrap metal are discharged;

(b) a source of hydraulic power for supplying hydraulic power to said apparatus housing:

(c) a feed roller powered by said source of hydraulic power for feeding metal structures in the scrap-receiving opening into the apparatus housing;

(d) a scrap fragmentizing roller powered by said source of hydraulic power and positioned in said apparatus housing between said scrap feeding roller and said discharge opening for fragmentizing the metal structures into small pieces of scrap metal as they are fed to the scrap fragmentizing roller from the scrap feeding roller, and discharging the fragmentized metal structures through the discharge opening said scrap fragmentizing means comprising a rotor having a plurality of outwardly-extending triangular teeth positioned in staggered relation around the periphery of the rotor, each of said teeth being aligned with the direction of rotation of said rotor;

(e) an anvil positioned between the scrap feeding means and the rotor, said anvil having a serrated edge defined by a plurality of laterally-extending triangular-shaped serrations positioned in corresponding alignment with respective ones of said triangular teeth and having a triangular shape corresponding to the triangular shape of said teeth; the plane of said teeth and the plane of said anvil intersecting to cause passage of said teeth past respective ones of said serrations in closely spaced-apart metal fragmentizing relation to each other; and (f) wherein said teeth are spaced on said rotor so that only one tooth is in cutting engagement with said anvil at any one time.

* * * * *